US008357077B2

(12) United States Patent
Taylor et al.

(10) Patent No.: US 8,357,077 B2
(45) Date of Patent: Jan. 22, 2013

(54) PHYSICAL FITNESS AND REHABILITATION APPARATUS

(75) Inventors: Bryce J. Taylor, Carmel, IN (US); Linda L. Normington, Indianapolis, IN (US)

(73) Assignee: Bryce J. Taylor, Indianapolis, IN (US)

( * ) Notice: Subject to any disclaimer, the term of this patent is extended or adjusted under 35 U.S.C. 154(b) by 0 days.

(21) Appl. No.: 12/816,257

(22) Filed: Jun. 15, 2010

(65) Prior Publication Data

US 2010/0331154 A1 Dec. 30, 2010

Related U.S. Application Data

(60) Provisional application No. 61/220,863, filed on Jun. 26, 2009.

(51) Int. Cl.
*A63B 26/00* (2006.01)

(52) U.S. Cl. ..... 482/142; 482/140; 482/139

(58) Field of Classification Search ..... 482/51, 482/142, 145–146, 148, 77, 135
See application file for complete search history.

(56) References Cited

U.S. PATENT DOCUMENTS 3,024,021 A 3/1962 Coplin et al.
3,306,626 A 2/1967 Kawada
3,572,701 A 3/1971 Agamian
3,604,726 A 9/1971 Tracy
3,716,229 A * 2/1973 Van Der Cleyen et al. ..... 482/77
3,862,768 A 1/1975 England
4,108,428 A 8/1978 Winterbottom
D256,706 S 9/1980 Gartin
4,232,863 A 11/1980 Roach
4,893,809 A * 1/1990 Blankenzee ..... 482/77
5,584,786 A 12/1996 Almeda
D385,318 S * 10/1997 Videtto ..... D21/688
D386,226 S 11/1997 Chen et al.
5,810,703 A 9/1998 Stack
5,897,474 A * 4/1999 Romero ..... 482/146
6,017,297 A 1/2000 Collins
D420,073 S 2/2000 Alessandri
6,019,712 A 2/2000 Duncan
6,068,580 A 5/2000 Myers et al.
6,146,343 A 11/2000 Stewart
6,168,551 B1 1/2001 McGuinness
6,422,983 B1 7/2002 Weck
6,554,753 B1 4/2003 Weck et al.
6,575,885 B1 6/2003 Weck et al.
D476,705 S 7/2003 Dillard
6,652,432 B2 11/2003 Smith
6,660,029 B2 12/2003 VanSkiver et al.
6,705,977 B1 3/2004 Ziak
6,811,523 B1 11/2004 Timmer
6,814,645 B2 * 11/2004 Kuk ..... 446/236
6,837,838 B2 1/2005 List
6,872,175 B2 * 3/2005 Lin ..... 482/146
6,916,276 B1 7/2005 Robinson
D509,548 S 9/2005 Heitzman et al.
7,060,015 B2 6/2006 Acher
D540,887 S * 4/2007 Goldman et al. ..... D21/413
7,264,580 B2 9/2007 Lu
D552,696 S * 10/2007 Hallar ..... D21/662
7,288,055 B2 10/2007 Blaum
(Continued)

*Primary Examiner* — Stephen Crow
(74) *Attorney, Agent, or Firm* — Faegre Baker Daniels LLP

(57) ABSTRACT

A physical fitness and rehabilitation apparatus is provided for use in combination with an inflatable exercise ball. The apparatus may include a plurality of handles. In use, a user may rest against the ball and the platform while gripping the plurality of handles to improve the user's strength, balance, flexibility, and/or joint stabilization.

20 Claims, 12 Drawing Sheets

U.S. PATENT DOCUMENTS

| | | | | |
|---|---|---|---|---|
| 7,300,392 | B1 | 11/2007 | Curran | |
| 7,303,512 | B1 * | 12/2007 | Goldman et al. | 482/77 |
| D564,604 | S | 3/2008 | Mikail | |
| 7,344,488 | B2 | 3/2008 | Weck et al. | |
| 7,357,767 | B2 | 4/2008 | Tsai | |
| 7,488,177 | B2 | 2/2009 | Pearson | |
| 7,494,446 | B2 | 2/2009 | Weck et al. | |
| 7,604,581 | B1 | 10/2009 | Williams | |
| 7,651,449 | B1 | 1/2010 | Balentine | |
| D625,370 | S | 10/2010 | Huber et al. | |
| D635,204 | S * | 3/2011 | Taylor et al. | D21/662 |
| 2004/0014571 | A1 | 1/2004 | Haynes | |
| 2006/0217242 | A1 | 9/2006 | Karpachev | |

* cited by examiner

PHYSICAL FITNESS AND REHABILITATION APPARATUS

CROSS REFERENCE TO RELATED APPLICATION

This application claims priority from U.S. Provisional Patent Application Ser. No. 61/220,863, entitled "PHYSICAL FITNESS AND REHABILITATION APPARATUS," filed Jun. 26, 2009, the disclosure of which is hereby expressly incorporated by reference herein in its entirety.

BACKGROUND

1. Field of the Invention

The present invention relates to a physical fitness and rehabilitation apparatus. More particularly, the present invention relates to a physical fitness and rehabilitation apparatus for improving strength, balance, flexibility, and joint stabilization, and to a method for using the same.

2. Description of the Related Art

Inflatable exercise balls (also known as Swiss balls) are used to enhance physical fitness and rehabilitation routines. Because the exercise ball forms an unstable surface, a user's core muscles and other stabilizer muscles must remain active to keep the exercise ball steady. In addition to gaining muscle strength, the exercise ball user may also improve his or her balance and reduce symptoms of pain, especially in his or her lower back and shoulders.

Various physical fitness and rehabilitation routines may be performed using an exercise ball. For example, the user may lie against the exercise ball in an inclined, plank position, as shown in FIGS. 1A and 1B, to work his or her triceps, obliques, chest muscles, shoulder muscles, back muscles, core muscles, and other stabilizer muscles. As another example, the user may squat against the exercise ball, as shown in FIG. 1C, to work his or her core muscles, leg muscles, and other stabilizer muscles. As yet another example, the user may sit upright on the exercise ball, as shown in FIG. 1D, to work his or her core muscles, leg muscles, and other stabilizer muscles. The user may also perform dynamic movements, such as sit-ups and push-ups, using the exercise ball.

SUMMARY

The present disclosure provides a physical fitness and rehabilitation apparatus for use in combination with an inflatable exercise ball. The apparatus may include a plurality of handles. In use, a user may rest against the ball and the platform while gripping the plurality of handles to improve the user's strength, balance, flexibility, and/or joint stabilization. The apparatus may be used with electronic gaming programs.

According to an embodiment of the present invention, a physical fitness and rehabilitation apparatus is provided for use in combination with a ball having a center, a top portion, a bottom portion, and a diameter. The apparatus includes a platform having a top surface, a bottom surface, and a plurality of handles, the platform defining an aperture that extends through the platform from the top surface to the bottom surface, the aperture sized to frictionally receive the ball therein with the top portion of the ball extending above the top surface of the platform and the bottom portion of the ball extending below the bottom surface of the platform.

According to another embodiment of the present invention, a physical fitness and rehabilitation apparatus is provided including a ball and a platform. The ball includes a center, a top portion, a bottom portion, and a diameter. The platform has a top surface, a bottom surface, and a plurality of handles, the platform defining an aperture that extends through the platform from the top surface to the bottom surface, the aperture sized to frictionally receive the ball at a location above the center of the ball.

According to yet another embodiment of the present invention, a method is set forth for providing a user with a physical fitness or rehabilitation apparatus for use in combination with a ball having a center, a top portion, a bottom portion, and a diameter. The method includes the steps of providing a platform having a top surface, a bottom surface, a plurality of handles, and an aperture sized to receive the ball such that the top portion of the ball extends above the top surface of the platform and the bottom portion of the ball extends below the bottom surface of the platform, and instructing the user to rest against the ball and the platform while gripping the plurality of handles.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1A:
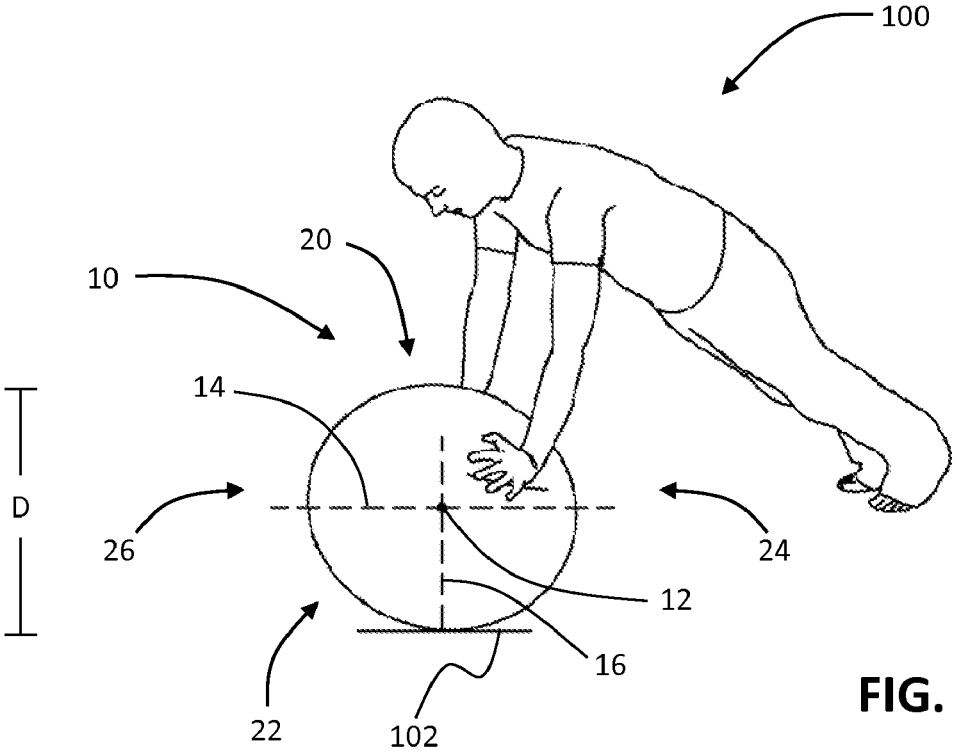
FIG. 1A is a perspective view of a user inclined against an inflatable exercise ball with his arms extended.

FIGS. 1A-1D depict an inflatable exercise ball 10 (also known as a Swiss ball) that may be used to improve a user's strength, balance, flexibility, and/or joint stabilization. Exercise ball 10 includes center 12. Horizontal plane 14 extends through center 12 of exercise ball 10 and divides exercise ball 10 into top portion 20 and bottom portion 22. Vertical plane 16 extends through center 12 of exercise ball 10 and divides exercise ball 10 into back portion 24 and front portion 26.

Exemplary exercise balls 10 are generally available in sizes ranging from approximately 35 cm (14 inches), 45 cm (18 inches), and 55 cm (22 inches) in diameter D to approximately 65 cm (26 inches), 75 cm (30 inches), and 85 cm (33 inches) in diameter D, for example. Such exercise balls 10 may be constructed of rubber or a thermoplastic polymer, such as polyvinyl chloride (PVC), and may be filled with air to an inflated pressure.

Figure 1B:
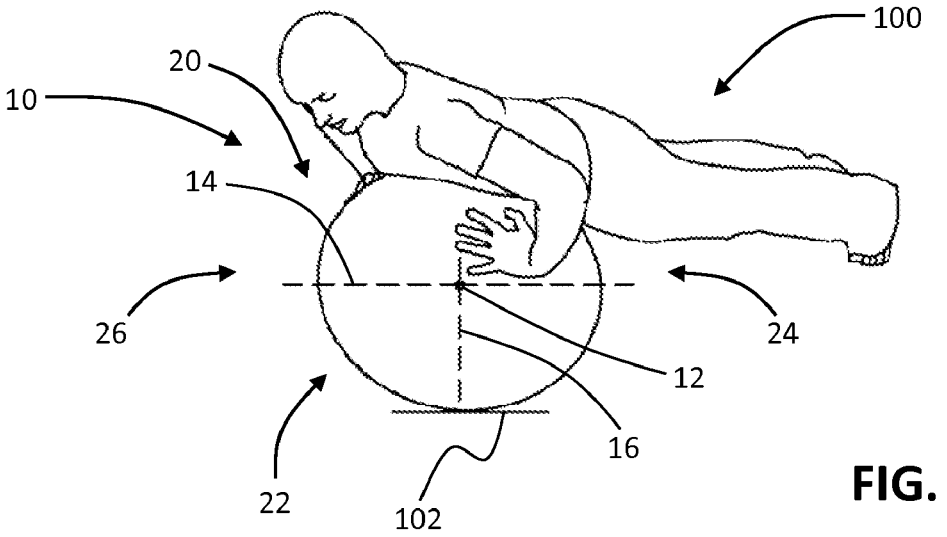
FIG. 1B is a perspective view of the user inclined against the inflatable exercise ball of FIG. 1A with his arms flexed.

In use, user 100 may lie upon exercise ball 10 in an inclined, plank position with his or her arms extended, as shown in FIG. 1A, or with his or her arms flexed, as shown in FIG. 1B. In both plank positions, user 100 rests against top portion 20 of exercise ball 10 and bottom portion 22 of exercise ball 10 rests against ground 102 or another suitable surface. To stabilize exercise ball 10, the hands of user 100 may rest behind vertical plane 16, such that user 100 contacts back portion 24 of exercise ball 10 to a greater extent than front portion 26 of exercise ball 10, as shown in FIGS. 1A and 1B. Alternatively, the hands of user 100 may rest substantially in vertical plane 16, such that user 100 contacts both back portion 24 and front portion 26 of exercise ball 10.

Figure 1C:
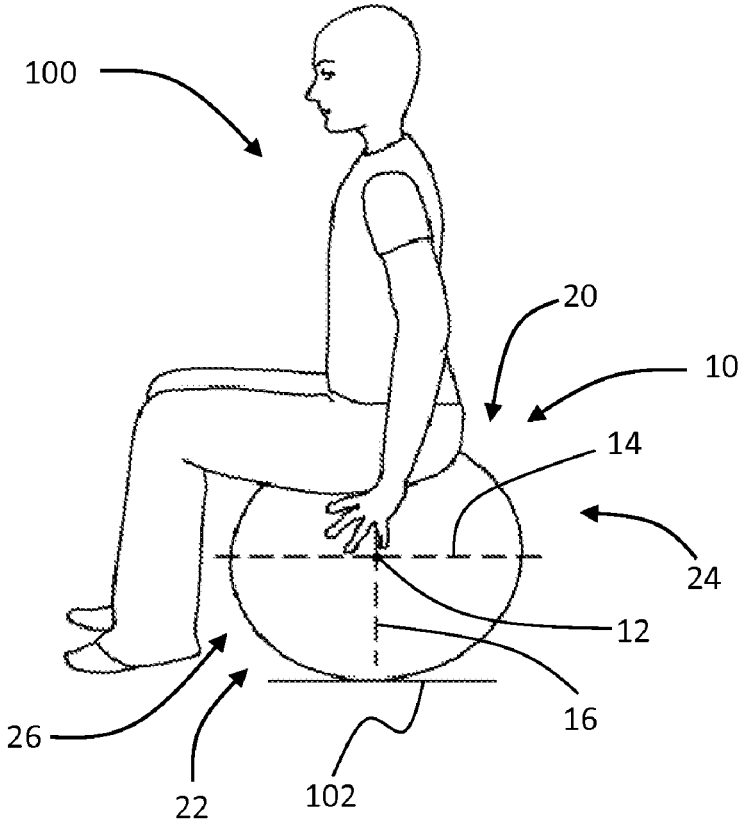
FIG. 1C is an elevational view of the user sitting atop the inflatable exercise ball of FIG. 1A.

Also, user 100 may sit upright atop exercise ball 10, as shown in FIG. 1C. In this sitting position, user 100 sits on top portion 20 of exercise ball 10 and bottom portion 22 of exercise ball 10 rests against ground 102 or another suitable surface. To stabilize exercise ball 10, the hands of user 100 may rest substantially in vertical plane 16, such that user 100 contacts both back portion 24 and front portion 26 of exercise ball 10, as shown in FIG. 1C.

Figure 1D:
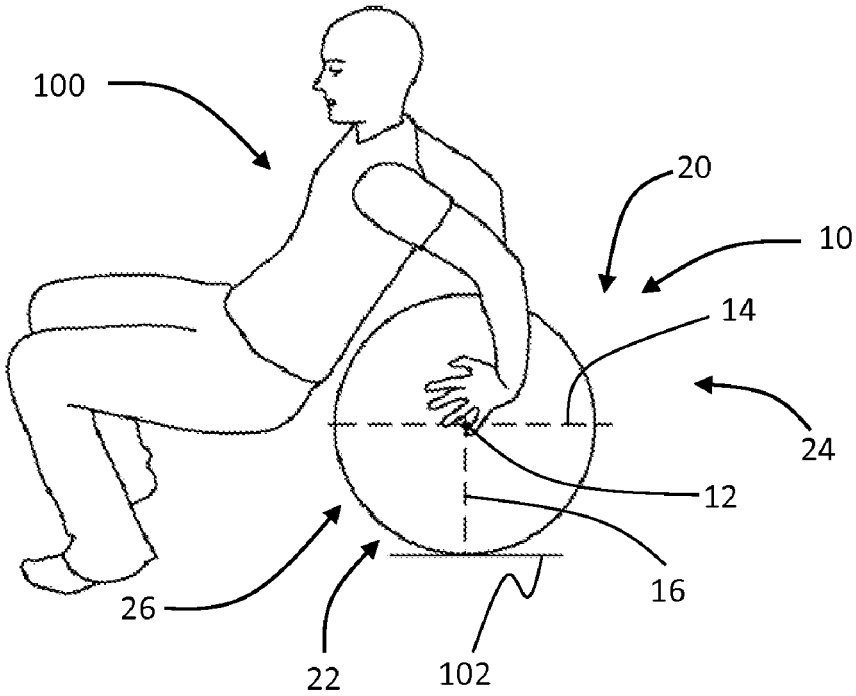
FIG. 1D is an elevational view of the user squatting in front of the inflatable exercise ball of FIG. 1A.

Additionally, user 100 may squat in front of exercise ball 10, as shown in FIG. 1D. In this squatting position, user 100 rests against top portion 20 of exercise ball 10 and bottom portion 22 of exercise ball 10 rests against ground 102 or another suitable surface. To stabilize exercise ball 10, the hands of user 100 may rest in front of vertical plane 16, such that user 100 contacts front portion 26 of exercise ball 10 to a greater extent than back portion 24 of exercise ball 10. Alternatively, and as shown in FIG. 1D, the hands of user 100 may rest substantially in vertical plane 16, such that user 100 contacts both back portion 24 and front portion 26 of exercise ball 10.

Figure 2:
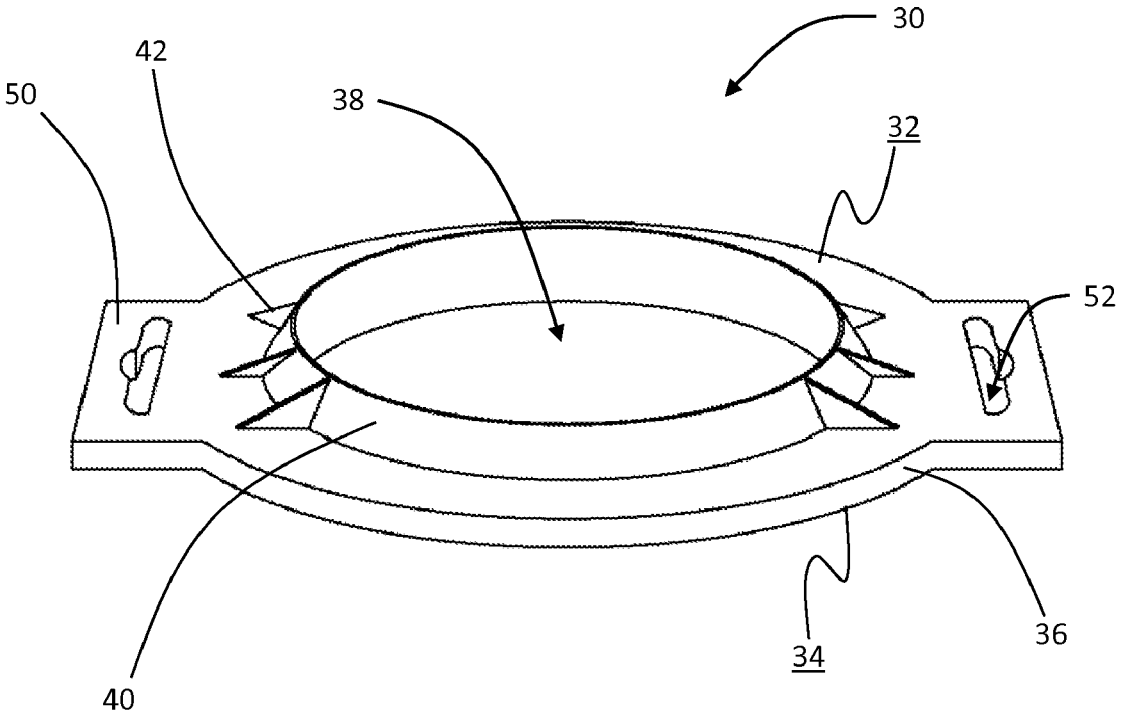
FIG. 2 is a rear perspective view of an exemplary platform of the present disclosure.
Figure 3:
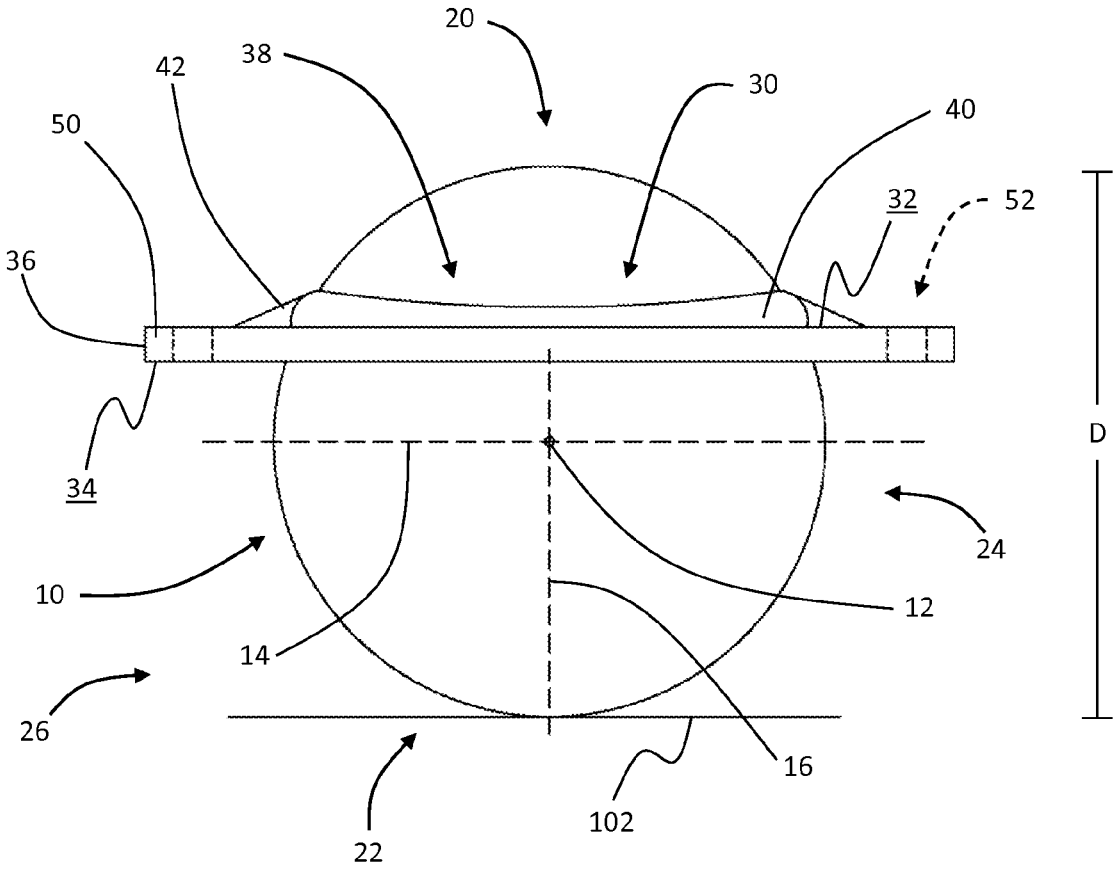
FIG. 3 is a rear elevational view of the platform of FIG. 2 mounted onto an inflatable exercise ball.
Figure 4:
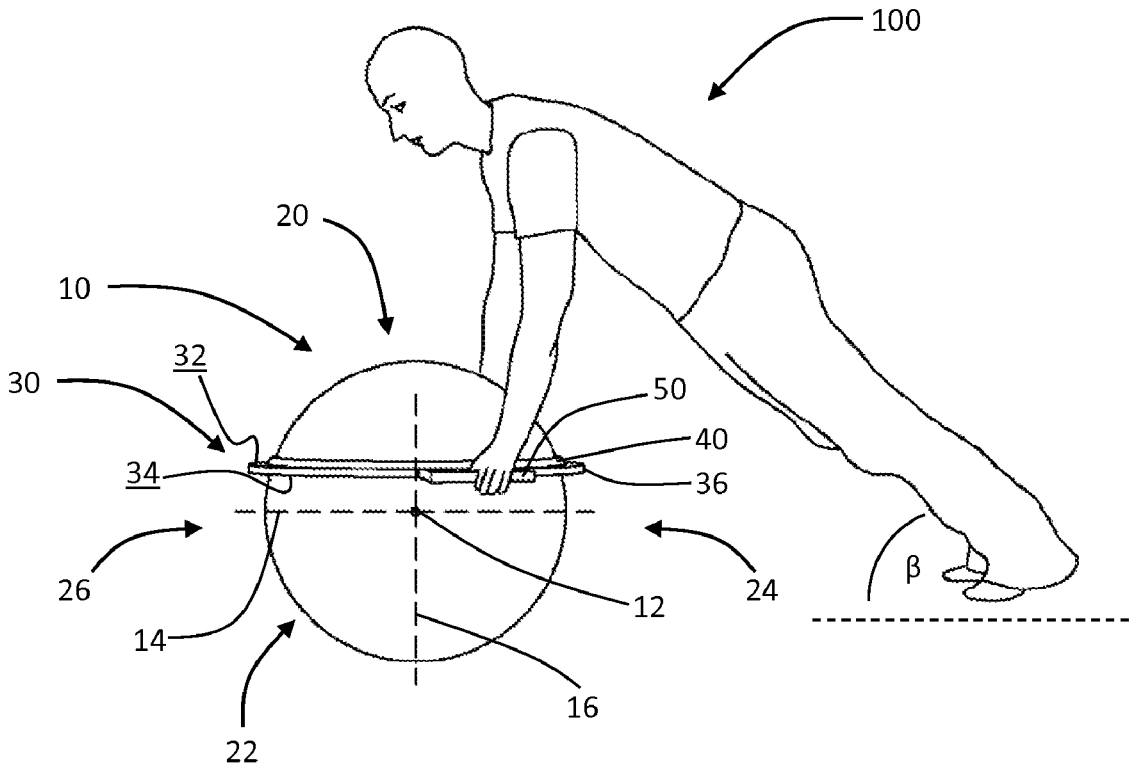
FIG. 4 is a side elevational view of a user inclined against the platform and the inflatable exercise ball of FIG. 3.

Referring to FIGS. 2-4, platform 30 is provided for use in combination with exercise ball 10. Platform 30 may improve the user's comfort, stability, safety, and range of motion when using exercise ball 10. Platform 30 may be constructed of metal (e.g. aluminum), plastic, or another suitable material, for example, and may be formed by rotational molding, injection molding, or another suitable process.

As shown in FIG. 2, platform 30 includes top surface 32, bottom surface 34, and outer periphery 36. Platform 30 also includes central aperture 38 that extends entirely through platform 30 from top surface 32 to bottom surface 34 of platform 30. In an exemplary embodiment, outer periphery 36 of platform 30 is substantially symmetrical about central aperture 38. In another exemplary embodiment, the distance between central aperture 38 and outer periphery 36 of platform 30 is minimized to, in turn, minimize the distance that outer periphery 36 of platform 30 extends from exercise ball 10 when mounted thereon, as described below.

As shown in FIG. 3, central aperture 38 of platform 30 is sized to removably receive and frictionally grip exercise ball 10 therein. In operation, platform 30 may be pressed downwardly onto top portion 20 of exercise ball 10 until platform 30 adequately grips exercise ball 10 in central aperture 38 and resists further downward movement. In an exemplary embodiment, central aperture 38 of platform 30 is sized to removably receive exercise ball 10 therein while exercise ball 10 is at a fully inflated or substantially inflated pressure, so that exercise ball 10 need not be inflated and deflated each time that platform 30 is mounted onto and removed from exercise ball 10.

As shown in FIGS. 2 and 3, platform 30 may further include crown or rim 40 that projects from top surface 32 and/or bottom surface 34 of platform 30 and surrounds central aperture 38. Rim 40 may be contoured to frictionally grip exercise ball 10 in central aperture 38 of platform 30. Platform 30 may also include radially-extending gussets 42 to support rim 40.

It is within the scope of the present disclosure that the size of central aperture 38 may be adjustable. For example, platform 30 may be provided with detachable rims 40 of various sizes to adjust the size of central aperture 38. As another example, platform 30 may be constructed of two sliding pieces (not shown) that narrow central aperture 38 when pushed together and that widen central aperture 38 when pulled apart. In this embodiment, a single platform 30 may be configured for use with exercise balls 10 of various sizes. Alternatively, a set of platforms 30 may be available in different sizes to accommodate exercise balls 10 of various sizes.

According to an exemplary embodiment of the present disclosure, with exercise ball 10 positioned within central aperture 38 of platform 30, top portion 20 of exercise ball 10 projects above top surface 32 of platform 30 and bottom portion 22 of exercise ball 10 projects beneath bottom surface 34 of platform 30, as shown in FIG. 3. For example, approximately one-eighth, one-quarter, or three-eighths of the diameter D of exercise ball 10, or more, may project above top surface 32 of platform 30.

According to another exemplary embodiment of the present disclosure, with exercise ball 10 positioned within central aperture 38 of platform 30, platform 30 is located above center 12 of exercise ball 10, as shown in FIG. 3. In other words, platform 30 is located above horizontal plane 14. If exercise ball 10 has a diameter D of approximately 55 cm (22 inches), for example, platform 30 may be located more than approximately 30 cm, 35 cm, 40 cm, 45 cm, or 50 cm from ground 102. If exercise ball 10 has a diameter D of approximately 65 cm (26 inches), for example, platform 30 may be located more than approximately 35 cm, 40 cm, 45 cm, 50 cm, 55 cm, or 60 cm from ground 102. As shown in FIG. 3, the width of exercise ball 10 increases beneath platform 30 toward horizontal plane 14 to prevent platform 30 from sliding downwardly over exercise ball 10 toward ground 102. In this embodiment, the diameter of central aperture 38 is less than the diameter D of exercise ball 10.

According to yet another exemplary embodiment of the present disclosure, with exercise ball 10 positioned within central aperture 38 of platform 30, exercise ball 10 maintains a substantially spherical shape, as shown in FIG. 3. For example, exercise ball 10 may not bulge outwardly above and below platform 30. Rather, diameter D of exercise ball 10 may remain substantially constant whether or not platform 30 is mounted onto exercise ball 10. Therefore, platform 30 is able to frictionally engage exercise ball 10 without substantially deforming exercise ball 10, which could cause exercise ball 10 to rupture or to become misshapen over time.

Platform 30 further includes substantially rigid handles 50 defined by apertures 52 that may be gripped by user 100 while using exercise ball 10. In use, user 100 grips handles 50 and wraps his or her fingers through the corresponding, adjacent apertures 52. Handles 50 may be provided with padding to enhance the user's comfort and/or a non-slip surface to enhance the user's grip. Handles 50 of platform 30 may enhance the user's ability to safely and comfortably stabilize exercise ball 10, thereby enabling certain physical rehabilitation patients or elderly patients to use exercise ball 10.

Handles 50 of platform 30 should mimic the user's hand placement when using exercise ball 10 without platform 30. Thus, handles 50 of platform 30 may be substantially aligned with vertical plane 16 of exercise ball 10, and may project backward and/or forward of vertical plane 16, so that user 100 may comfortably rest above back portion 24 and/or front portion 26 of exercise ball 10.

With platform 30 mounted atop exercise ball 10, top portion 20 of exercise ball 10 may project above handles 50 of platform 30, as shown in FIG. 4. However, it is also within the scope of the present disclosure that handles 50 of platform 30 may project above top portion 20 of exercise ball 10 and toward user 100.

The distance between handles 50 may be chosen to accommodate the distance between an average user's arms. For example, handles 50 may be spaced apart by approximately 35 cm, 40 cm, 45 cm, 50 cm, 55 cm, 60 cm, 65 cm, or 70 cm. It is within the scope of the present disclosure that handles 50 may be adjustable to comfortably accommodate various users 100, such as men, women, and children. In certain embodiments, the distance between handles 50 may be less than the diameter D of exercise ball 10. Thus, when viewing platform 30 and exercise ball 10 from the top, the width of exercise ball 10 beneath handles 50 would project outwardly beyond handles 50. Also, in certain embodiments, the distance between handles 50 may be less than or substantially equal to the vertical distance between platform 30 and ground 102.

In use, user 100 may hover over exercise ball 10 in an inclined, plank position with his or her arms extending forwardly and downwardly to grip handles 50, as shown in FIG. 4. Also, user 100 may sit upright atop exercise ball 10 (similar to the position shown in FIG. 1C) with his or her arms extending downwardly to grip handles 50, or user 100 may squat in front of exercise ball 10 (similar to the position shown in FIG. 1D) with his or her arms extending backwards to grip handles 50.

User 100 may grip handles 50 of platform 30 while holding platform 30 and exercise ball 10 in a stationary position. Alternatively, user 100 may grip handles 50 while tilting platform 30 and exercise ball 10 side to side, backwards, and forwards. In both conditions, user 100 will work his or her triceps, obliques, chest muscles, shoulder muscles, back muscles, core muscles, and other stabilizer muscles for improved strength, balance, flexibility, and/or joint stability.

Figure 5:
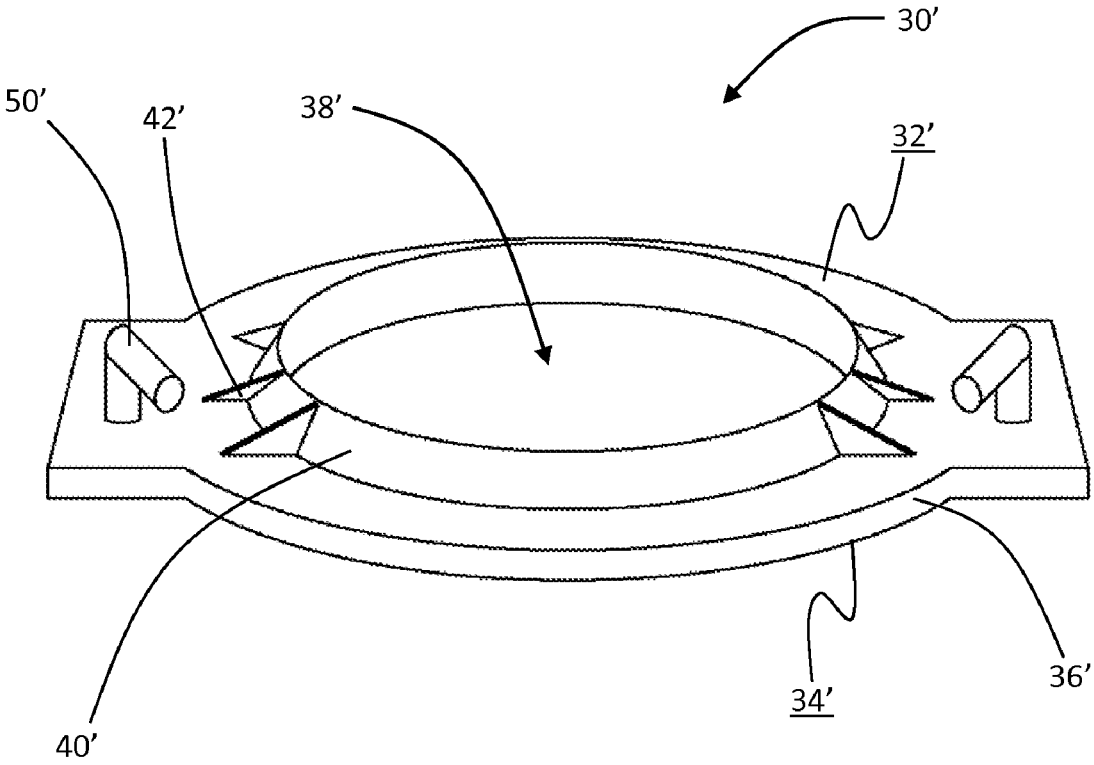
FIG. 5 is a rear perspective view of another exemplary platform of the present disclosure.
Figure 6:
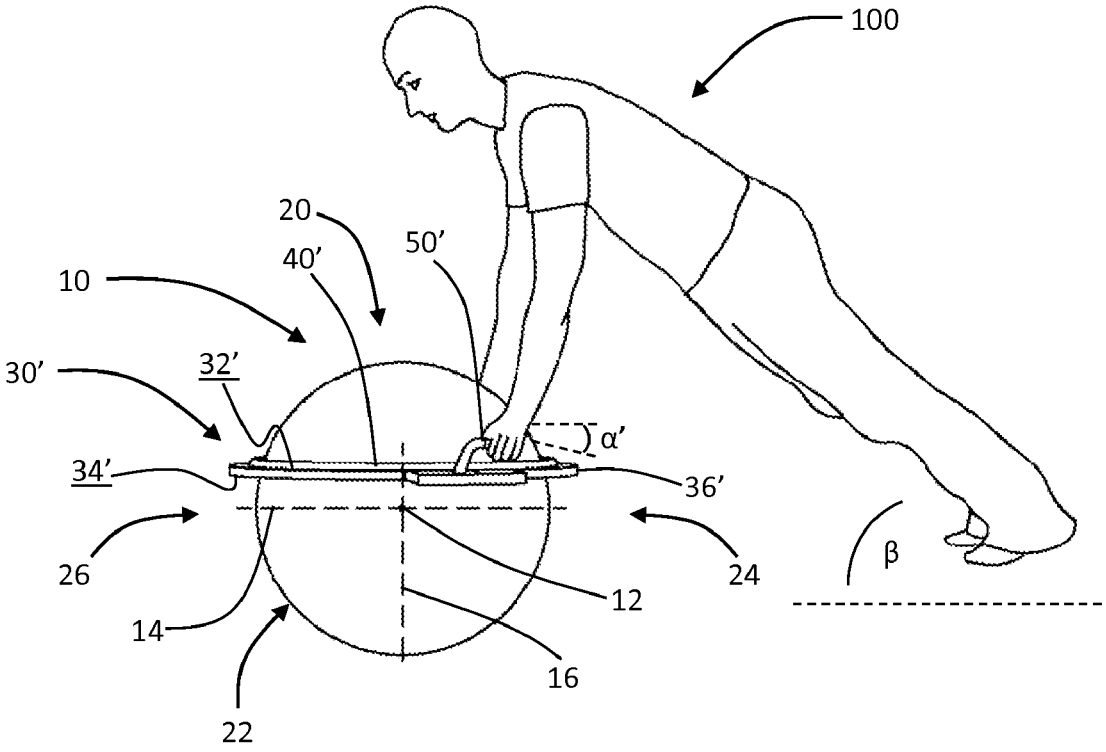
FIG. 6 is a side elevational view of a user inclined against the platform of FIG. 5, which is mounted onto an inflatable exercise ball.

Referring next to FIGS. 5 and 6, another platform 30' is provided for use in combination with exercise ball 10. Platform 30' of FIGS. 5 and 6 may include certain features similar to those of platform 30 of FIGS. 2-4, with like reference numerals indicating like elements, except as described below. Platform 30' may be constructed of metal (e.g. aluminum), plastic, or another suitable material, for example, and may be formed by rotational molding, injection molding, or another suitable process.

As shown in FIGS. 5 and 6, handles 50' of platform 30' project upwardly from top surface 32' of platform 30' toward user 100. Thus, even if top surface 32' of platform 30' rests low on exercise ball 10, handles 50' may project upwardly toward user 100 for improved comfort and stability. In an exemplary embodiment, handles 50' may project inwardly toward center 12 of exercise ball 10, as shown in FIG. 5. Thus, even if outer periphery 36 of platform 30 is wider than an average user's arms, handles 50' may project inwardly to achieve a more natural and comfortable spacing. In another exemplary embodiment, each handle 50' may angle downwardly at angle $\alpha'$ to ergonomically accommodate the user's inclined position, as shown in FIG. 6. Angle $\alpha'$ may equal approximately 20 degrees, 25 degrees, 30 degrees, 35 degrees, or 40 degrees, for example.

Figure 7:
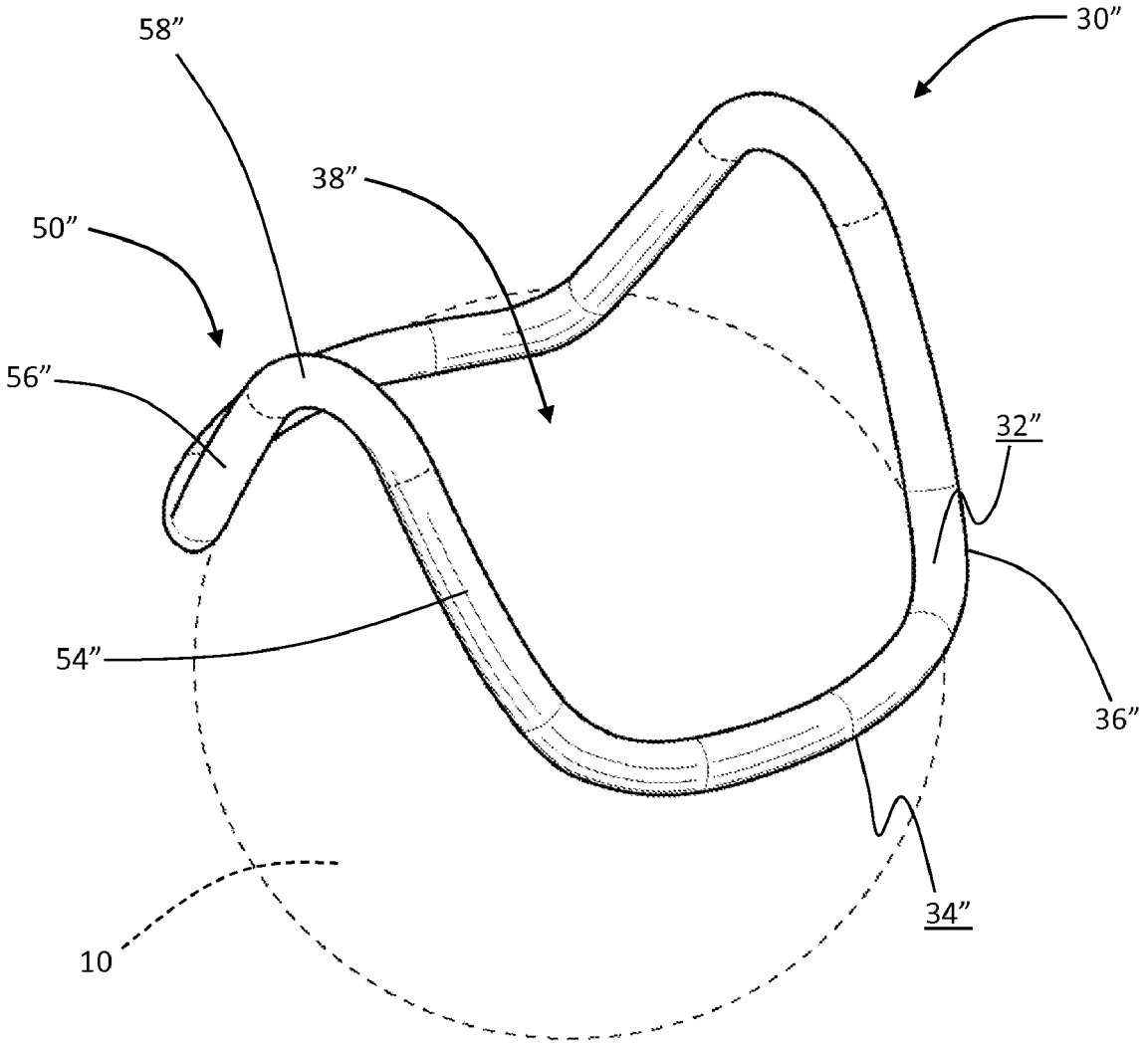
FIG. 7 is a rear perspective view of yet another exemplary platform of the present disclosure, which is mounted onto an inflatable exercise ball (shown in phantom)
Figure 8:
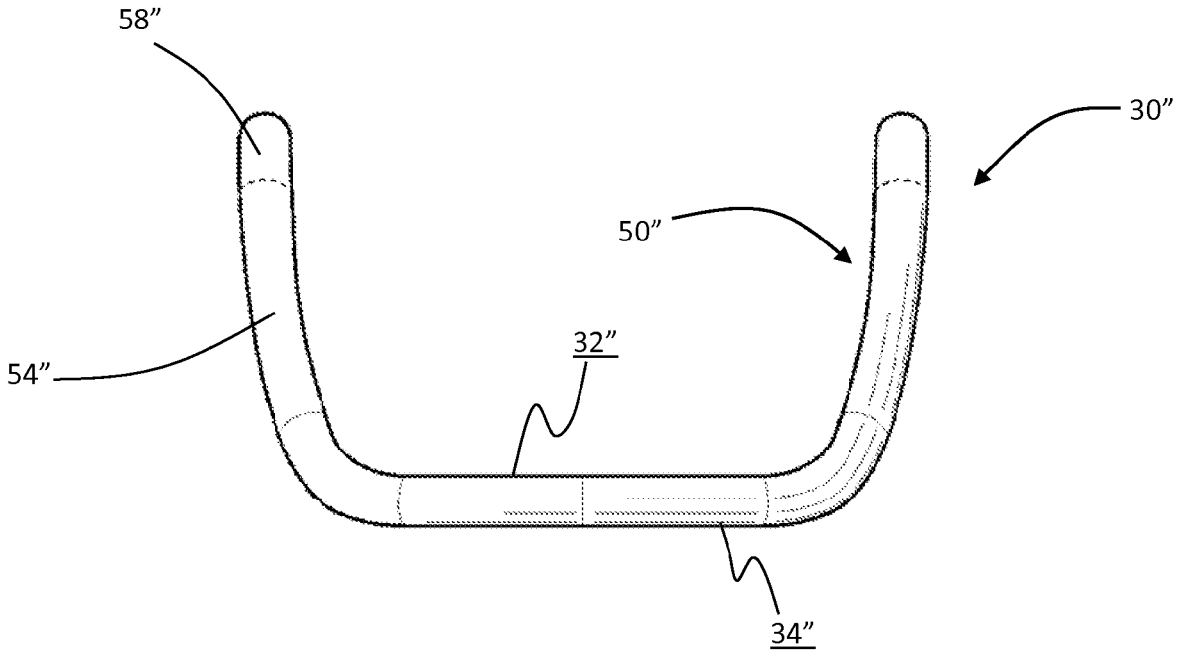
FIG. 8 is a rear elevational view of the platform of FIG. 7.

Referring next to FIGS. 7-10 and 11A-11C, another platform 30" is provided for use in combination with exercise ball 10. Platform 30" of FIGS. 7-10 may include certain features similar to those of platform 30 of FIGS. 2-4 and/or platform 30' of FIGS. 5 and 6, with like reference numerals indicating like elements, except as described below. As shown in FIG. 7, platform 30" is a substantially ring-shaped apparatus. To minimize its weight, platform 30" may be a hollow or generally tubular construct. Platform 30" may be constructed of metal (e.g. aluminum), plastic, or another suitable material, for example.

Figure 11A:
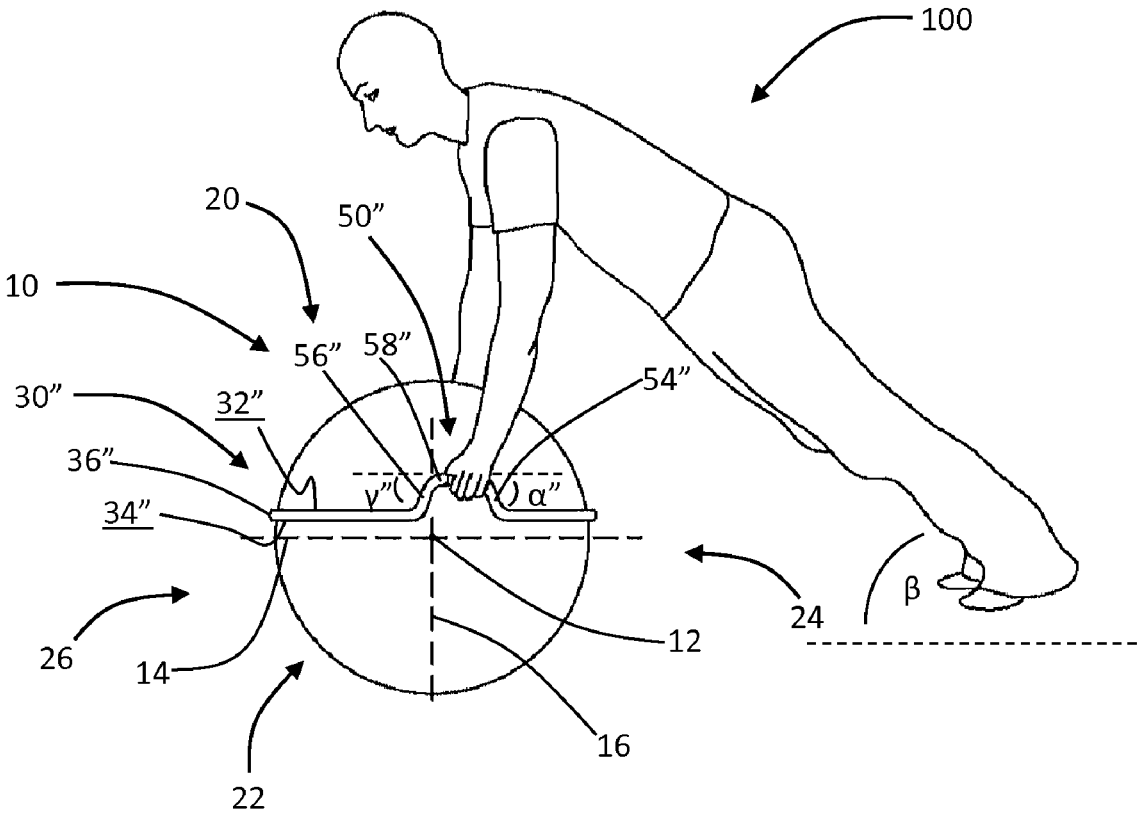
FIG. 11A is a side elevational view of a user inclined against a platform and an inflatable exercise ball similar to those shown in FIG. 7.
Figure 11B:
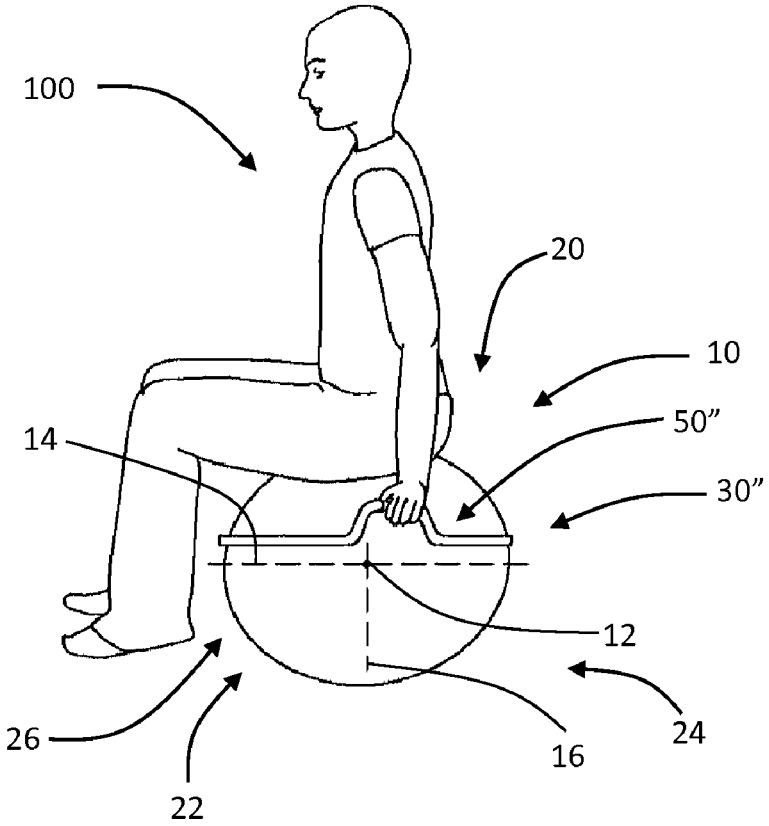
FIG. 11B is a side elevational view of the user sitting atop the inflatable exercise ball while gripping the platform of FIG. 11A.
Figure 11C:
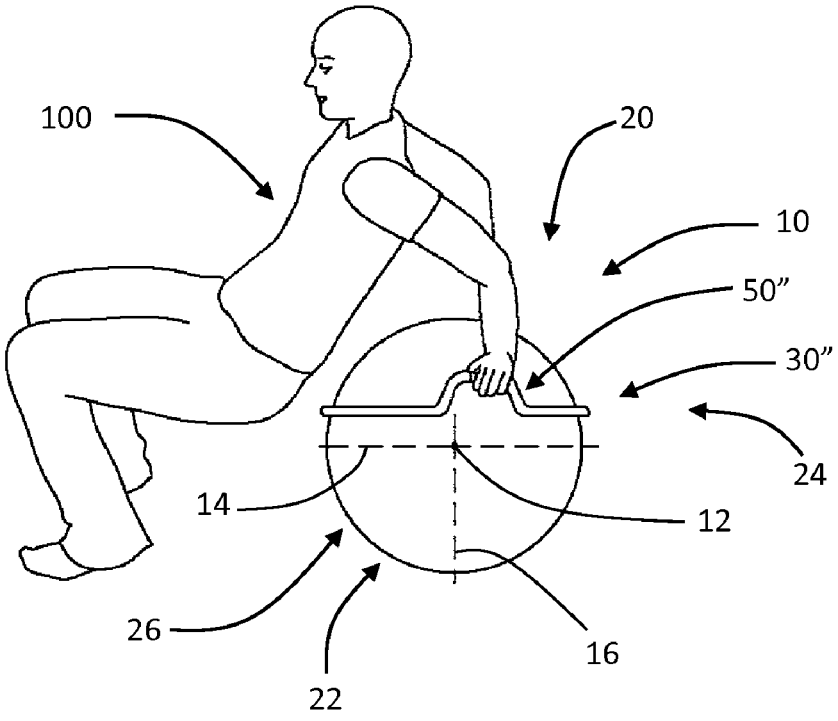
FIG. 11C is a side elevational view of the user squatting in front of the inflatable exercise ball while gripping the platform of FIG. 11A.

Top surface 32" of platform 30" projects upwardly toward user 100 to define substantially V-shaped handles 50". As shown in FIG. 11A, each handle 50" includes back portion 54" that faces back portion 24 of exercise ball 10, front portion 56" that faces front portion 26 of exercise ball 10, and top portion 58" that faces user 100 and/or top portion 20 of exercise ball 10. Top portion 58" of each handle 50" may be located substantially within vertical plane 16. Also, top portion 58" of each handle 50" may project vertically above exercise ball 10 toward user 100, as shown in FIG. 7, or top portion 58" of each handle 50" may be vertically aligned with top portion 20 of exercise ball 100, as shown in FIGS. 11A-11C.

Figure 9:
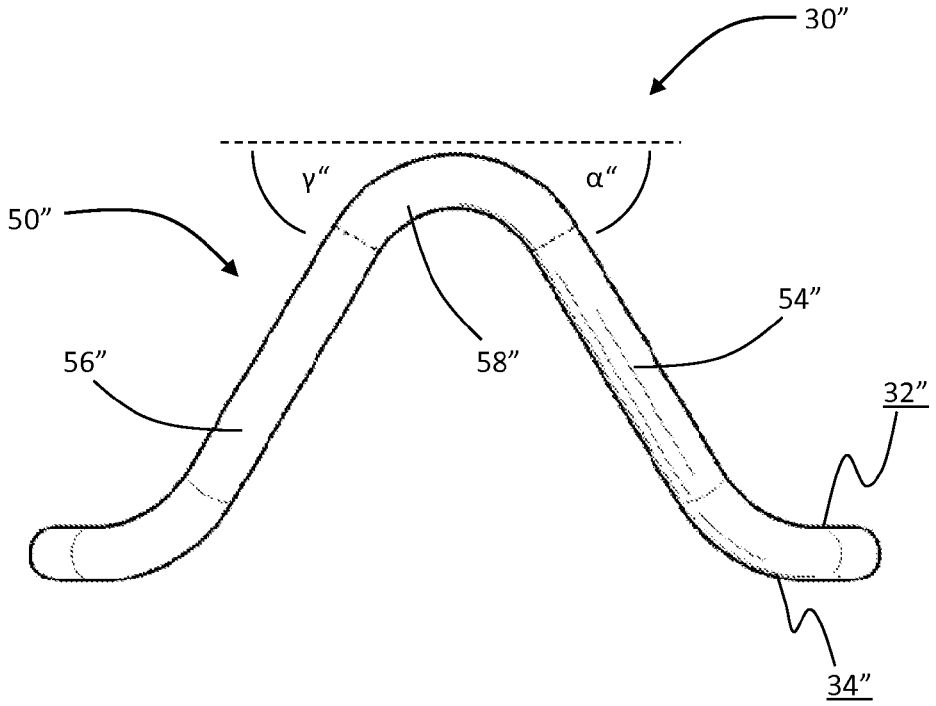
FIG. 9 is a side elevational view of the platform of FIG. 7.
Figure 10:
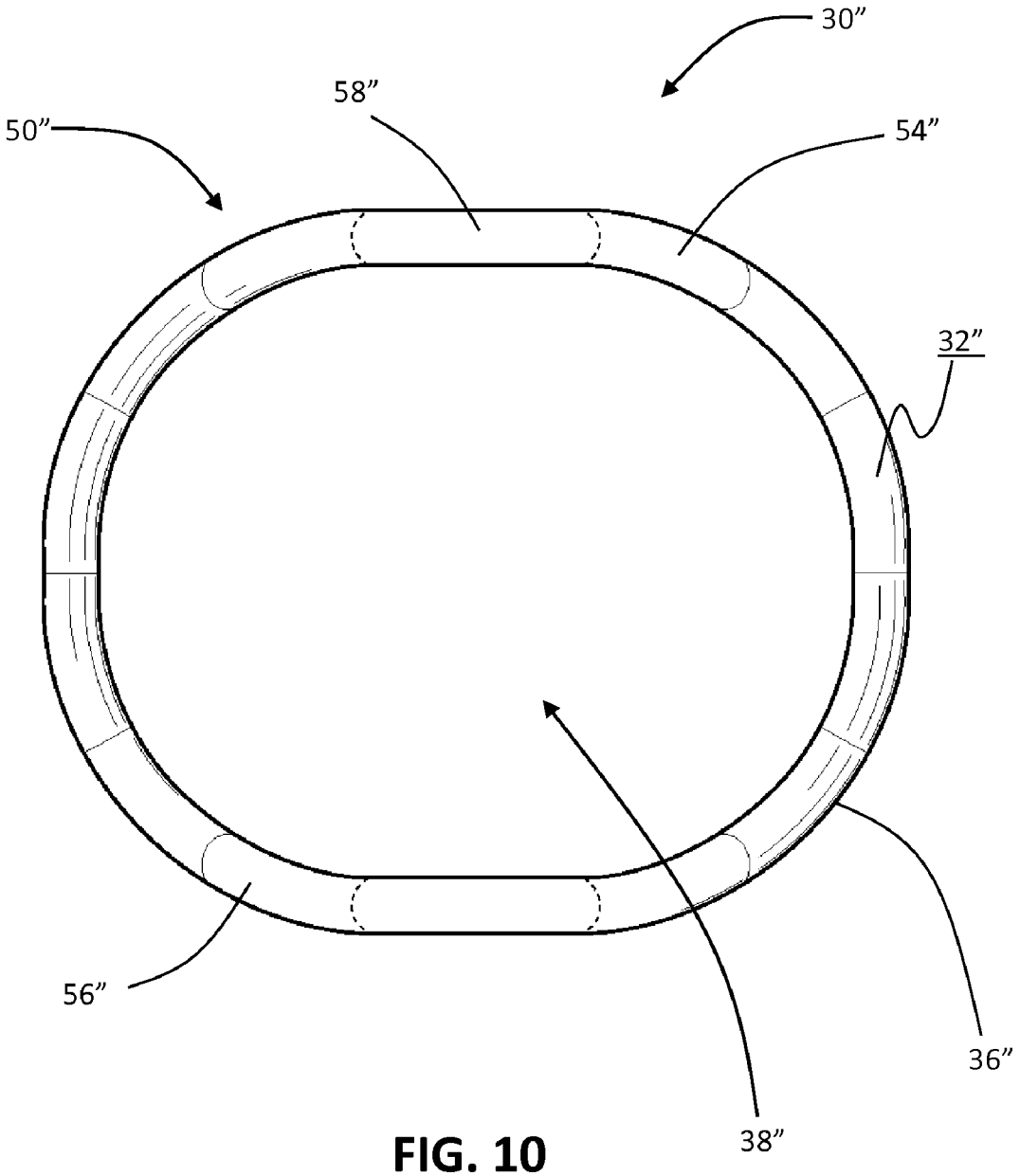
FIG. 10 is a top plan view of the platform of FIG. 7.

Like handles 50' of platform 30', handles 50" of platform 30" are angled to ergonomically accommodate user 100 in various positions. Back portion 54" of each handle 50" may be located behind vertical plane 16 and may angle downwardly at angle $\alpha''$, as shown in FIG. 9. Angle $\alpha''$ may equal approximately 20 degrees, 25 degrees, 30 degrees, 35 degrees, 40 degrees, 45 degrees, 50 degrees, 55 degrees, 60 degrees, 65 degrees, 70 degrees, or more. For example, in the illustrated embodiment of FIG. 9, angle $\alpha''$ is approximately 60 degrees. Front portion 56" of each handle 50" may be located in front of vertical plane 16 and may angle downwardly at angle $\gamma''$. In the illustrated embodiment of FIG. 9, angle $\gamma''$ is substantially the same as angle $\alpha''$. However, it is within the scope of the present disclosure that angle $\gamma''$ may differ from angle $\alpha''$. For example, angle $\gamma''$ may equal approximately 10 degrees, 15 degrees, 20 degrees, 25 degrees, or 30 degrees.

In use, user 100 may hover over exercise ball 10 in an inclined, plank position with his or her arms extending forwardly and downwardly to grip back portion 54" and/or top portion 58" of handles 50", as shown in FIG. 11A. Also, user 100 may sit upright atop exercise ball 10 with his or her arms extending downwardly to grip top portion 58" of handles 50". Additionally, user 100 may squat in front of exercise ball 10 with his or her arms extending backwards to grip back portion 54", front portion 56", and/or top portion 58" of handles 50", as shown in FIG. 11C. In this embodiment, handles 50" of platform 30" may comfortably accommodate the user's hands as if using exercise ball 10 without platform 30".

Compared to known balance board devices designed for standing, platforms 30, 30', 30", of the present disclosure may be more elevated relative to ground 102. For example, platforms 30, 30', 30", may be located more than approximately 30 cm, 35 cm, 40 cm, 45 cm, 50 cm, 55 cm, or 60 cm above ground 102. As a result, each platform 30, 30', 30", may be used to perform physical fitness and/or rehabilitation routines at greater angles of inclination β relative to ground 102. For example, depending on the height and arm length of user 100, user 100 may achieve an angle of inclination β relative to ground 102 of approximately 15 degrees, 20 degrees, 25 degrees, 30 degrees, 35 degrees, 40 degrees, or more, as shown in FIG. 11A.

The elevated position of each platform 30, 30', 30", provides several benefits.

First, the elevated position of each platform 30, 30', 30", allows user 100 to expand his or her physical fitness routine. For example, when user 100 lies in the plank position close to ground 102, the user's weight is substantially balanced between his or her arms and legs, but when user 100 lies against the selected platform 30, 30', 30", in the inclined, plank position, the user's weight shifts away from exercise ball 10 and toward his or her feet. Thus, user 100 may work different muscle groups using platforms 30, 30', 30".

Also, the elevated position of each platform 30, 30', 30", accommodates physical rehabilitation patients or elderly patients that may be unable to lie, squat, or sit close to ground 102. For example, the patient may lack sufficient strength to lie, squat, or sit close to ground 102. Over time, the patient may be encouraged to lie, squat, or sit closer and closer to ground 102 by selecting exercise balls 10 of smaller and smaller diameters D.

Additionally, the elevated position of each platform 30, 30', 30", allows user 100 to tilt the corresponding platform 30, 30', 30", and exercise ball 10 side to side, backwards, and forwards to a significant degree without platform 30, 30', 30", contacting ground 102, which would limit the range of motion of platform 30, 30', 30", and exercise ball 10.

Moreover, the elevated position of each platform 30, 30', 30", allows user 100 to comfortably view a television set or another display while exercising. According to an exemplary embodiment of the present disclosure, user 100 may perform the above-described movements along with an interactive gaming program. For example, user 100 may rest exercise ball 10 atop an electronic sensor board, such as the Wii™ Balance Board currently available from Nintendo of America Inc. As user 100 tilts the selected platform 30, 30', 30", and exercise ball 10 side to side, backwards, and forwards, the Wii™ Balance Board tracks movement of exercise ball 10 and incorporates that movement into a gaming environment. In this exemplary embodiment, user 100 is able to play games while lying in an inclined, plank position on exercise ball 10, squatting against exercise ball 10, or sitting atop exercise ball 10, rather than simply standing on the Wii™ Balance Board, all while comfortably viewing the game on a television set or another display.

After user 100 finishes his or her exercises, user 100 is able to remove the selected platform 30, 30', 30", from exercise ball 10. Exercise ball 10 may then be used for other exercises, such as sit-ups. Thus, platforms 30, 30', 30", serve as accessories to exercise ball 10, and exercise ball 10 retains flexibility of usage. It is also within the scope of the present disclosure that platforms 30, 30', 30", may be fixedly coupled or integrally formed with exercise ball 10.

According to an exemplary embodiment of the present disclosure, each platform 30, 30', 30", may be sold in a kit along with a suitable exercise ball 10. Also, each platform 30, 30', 30", may include instructions for safely and properly using the selected platform 30, 30', 30". For example, instructions may be provided with platform 30" for safely and properly hovering over, squatting next to, and sitting atop exercise ball 10 while gripping handles 50" of platform 30", such as in the positions shown in FIGS. 11A-11C.

While this invention has been described as having preferred designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of using a physical fitness or rehabilitation apparatus comprising the steps of:

providing a platform for use with an inflated structure, the platform having a top surface, a bottom surface, a plurality of handles, and an aperture sized to receive the inflated structure, the platform also having a generally planar cross-section between the top and bottom surfaces, the plurality of handles being located outside of the cross-section of the platform such that the plurality of handles is non-coplanar with the cross-section of the platform, the inflated structure having a top portion and a bottom portion, the top portion of the inflated structure extending above the top surface of the platform and the bottom portion of the inflated structure extending below the bottom surface of the platform when the inflated structure is received in the aperture of the platform; and gripping the plurality of handles with a user's hands while the user's feet and the bottom portion of the inflated structure are positioned on the ground.

2. The method of claim 1, wherein the user's arms extend in front of the user during the gripping step.

3. The method of claim 1, wherein the user's arms extend behind the user during the gripping step.

4. The method of claim 1, wherein the top portion of the inflated structure is located between the user's arms during the supporting step.

5. The method of claim 1, wherein the plurality of handles includes a left handle and a right handle, the left handle extending along a first, left plane and the right handle extending along a second, right plane, the left and right planes being spaced apart from one another and parallel to one another.

6. A method of using a physical fitness or rehabilitation apparatus comprising the steps of:

providing a platform for use with an inflated structure, the platform comprising a top surface, a bottom surface, a plurality of rigid handles, and an aperture sized to receive the inflated structure, the inflated structure having a top portion and a bottom portion, the top portion of the inflated structure extending above the top surface of the platform and the bottom portion of the inflated structure extending below the bottom surface of the platform when the inflated structure is received in the aperture of the platform;

gripping the plurality of rigid handles with a user's hands while the user's feet and the bottom portion of the inflated structure are positioned on the ground; and manipulating the plurality of rigid handles to tilt the inflated structure relative to the ground, the plurality of rigid handles moving with the top and bottom surfaces of the platform, without freedom of movement relative to the top and bottom surfaces of the platform, to transfer movement of the plurality of rigid handles to the inflated structure to tilt the inflated structure relative to the ground.

7. The method of claim 6, wherein the platform consists essentially of the top surface, the bottom surface, the plurality of rigid handles, and the aperture sized to receive the inflated structure.

8. The method of claim 6, wherein the manipulating step comprises tilting the inflated structure side to side, backward, and forward relative to the ground.

9. The method of claim 6, wherein the manipulating step comprises rolling the inflated structure over a tracking board positioned on the ground.

10. The method of claim 6, wherein the gripping step comprises supporting the user's body weight over the plurality of rigid handles.

11. The method of claim 6, wherein the user's arms extend downward from the user's body toward the plurality of rigid handles during the gripping step.

12. The method of claim 6, wherein the plurality of rigid handles is positioned above the inflated structure during the gripping step.

13. The method of claim 6, wherein the inflated structure comprises a spherical ball.

14. The method of claim 6, further comprising the step of removing the platform from the inflated structure.

15. A method of using a physical fitness or rehabilitation apparatus comprising the steps of:

providing a platform for use with an inflated structure, the platform consisting essentially of a top surface, a bottom surface, a plurality of rigid handles, and an aperture sized to receive the inflated structure, the plurality of rigid handles moving with the top and bottom surfaces of the platform without freedom of movement relative to the top and bottom surfaces of the platform, the inflated structure having a top portion and a bottom portion, the top portion of the inflated structure extending above the top surface of the platform and the bottom portion of the inflated structure extending below the bottom surface of the platform when the inflated structure is received in the aperture of the platform; and gripping the plurality of rigid handles with a user's hands while the user's feet and the bottom portion of the inflated structure are positioned on the ground.

16. The method of claim 15, wherein the gripping step comprises supporting the user's body weight over the plurality of rigid handles.

17. The method of claim 15, wherein the user's arms extend downward from the user's body toward the plurality of rigid handles during the gripping step.

18. The method of claim 15, wherein the plurality of rigid handles is positioned above the inflated structure during the gripping step.

19. The method of claim 15, further comprising stabilizing the inflated structure during the gripping step by maintaining the inflated structure in a stationary position on the ground.

20. The method of claim 15, wherein the platform is in the shape of a continuous ring, the plurality of rigid handles forming a portion of the continuous ring.

* * * * *